United States Patent [19]

Dahlberg et al.

[11] Patent Number: 4,624,416

[45] Date of Patent: Nov. 25, 1986

[54] PROCEDURE FOR CLASSIFYING A CRYSTAL MIXTURE OR CONCENTRATING ROCKS OR MIXED CRYSTALS IN PARTICLE FORM

[75] Inventors: Kjell A. M. Dahlberg; Urho V. Valtakari, both of Pargas, Finland

[73] Assignee: Oy Partek AB, Parainen, Finland

[21] Appl. No.: 716,591

[22] Filed: Mar. 18, 1985

Related U.S. Application Data

[63] Continuation of Ser. No. 459,560, Jan. 20, 1983, abandoned.

[30] Foreign Application Priority Data

Jan. 20, 1983 [FI] Finland ..... 820322

[51] Int. Cl.[4] ..... B02C 19/00

[52] U.S. Cl. ..... 241/1; 241/14; 241/19; 241/23; 241/24

[58] Field of Search ..... 241/1, 14, 19, 23, 24

[56] References Cited

U.S. PATENT DOCUMENTS

| | | | |
|---|---|---|---|
| 3,202,502 | 8/1965 | Lean et al. | 241/23 X |
| 3,397,844 | 8/1968 | Whaley et al. | 241/80 X |
| 3,402,895 | 9/1968 | Willmann | 241/80 X |
| 3,797,757 | 3/1974 | Marshall | 241/1 |
| 3,865,541 | 2/1975 | Wilson et al. | 241/23 X |
| 4,253,940 | 3/1981 | Price | 241/23 X |

FOREIGN PATENT DOCUMENTS

| | | | |
|---|---|---|---|
| 416092 | 7/1974 | U.S.S.R. | 241/23 |

*Primary Examiner*—Howard N. Goldberg
*Assistant Examiner*—Timothy V. Eley
*Attorney, Agent, or Firm*—Biebel, French & Nauman

[57] ABSTRACT

A process for classifying a crystal mixture or for concentrating rocks or mixed crystals in particle form by capturing the particles in a gas flow for the purpose of separating particles of different size and weight by means of natural or artificial gravity is disclosed. The particles are heated to a temperature so high that a difference sufficient for separation is obtained in volume or weight between different particles. For spodumene, quartz and feldspar this temperature is about 1000° C.

6 Claims, 2 Drawing Figures

PROCEDURE FOR CLASSIFYING A CRYSTAL MIXTURE OR CONCENTRATING ROCKS OR MIXED CRYSTALS IN PARTICLE FORM

This is a continuation of Ser. No. 459,560, filed 1/20/83 which is now abandoned.

BACKGROUND OF THE INVENTION

The present invention relates to a process for classifying a crystal mixture or for concentrating rocks or mixed crystals in particle form by capturing the particles in a gas flow for separation of particles of different sizes and/or weights by means of natural or artificial gravity. The present invention is particularly suitable for classifying a mixture of different kinds of crystal particles or for concentrating finely divided rocks or mixed crystals with densities so close to each other that they cannot in any practical way be separated using conventional methods or means, such as flotation cells.

In this connection, 'crystal mixture' is understood to mean a mixture of two or more crystal types, while the expression 'mixed crystals' refers to a mixture of crystals of varying composition. An example of 'artificial gravity' is represented by cyclone separation.

Nowadays, concentrating of minerals is most often accomplished by chemical flotation methods, magnetic separation methods or by grinding or sifting methods. According to their chemical, physical or structural properties, minerals behave in different ways depending on the environment in which they are treated. Different minerals require different concentrating methods, which naturally also have their peculiar advantages and disadvantages. Chemical flotation methods require chemicals which, in view of environment protection, should be maximally recoverable and reusable. The flotation processes of prior art are to a large extent based on practical applications, which implies that it is difficult to predict the course of the process directly on the basis of chemical and physical laws. Concentration by grinding and sifting is greatly dependent on the different minerals' physical properties, the hardness of the minerals being decisive, and grinding equipment of a special nature is frequently needed in order to attain good concentration results.

The object of the present invention is therefore to provide a process for classifying a crystal mixture or for concentrating rocks or mixed crystals in particle form wherein the different particles have so closely identical properties under normal separation circumstances that separation is either impossible or hard to accomplish, or to induce a selective change in those properties on which the separation is based, so that the separation is substantially facilitated.

SUMMARY OF THE INVENTION

As taught by the invention, the particles are therefore heated before or during separation to a temperature so high that an adequate difference for separation is obtained in volume and/or weight between the different particles. Since the separation takes place in a gas flow on the basis of different particle weight or volume, endeavours have therefore been made to induce a selective change in these parameters in such manner that the weight and/or volume of different particles changes owing to either reorganisation within the particle, interchange with the environment, heat exchange or decomposition, etc.

Since the physical and structural properties of different crystals and minerals vary as a function of the temperature, the present invention is accordingly based on the behaviour of different crystals and minerals in different thermal conditions. Rocks containing different mineral compositions can by means of thermal treatment in an expedient apparatus be so affected that a given mineral fraction can be concentrated. If the different minerals in rocks or crystals have suitably large differences of physical properties like hardness, thermal conductivity and thermal expansion and if the structure of a given mineral or crystal changes due to thermal circumstances, it is possible to achieve concentration of a mineral or crystal fraction by selecting an appropriate reactor type and appropriate flow conditions.

Compared with chemical flotation methods, thermal concentration enables the following advantages to be gained: the process may take place in a dry environment; use of chemicals is avoided; grinding becomes simpler.

Thus, the present thermal concentrating process is based on the physical and structural properties of different minerals and crystals, and on how these properties vary as a function of temperature. Physical properties like hardness, thermal conductivity and thermal expansion, as well as structural transformations, are in this connection significant parameters, and in the case of mineral and crystal compositions, when they can be combined, the concentration process may be further improved. By means of the process of the invention, even particles with closely equal density but with different thermal expansion may be classified through their change in volume. In the treatment of chemical salt mixtures, e.g. various hydrates (gypsum), differences can be produced in the particle shape of different salts, whereafter the particles of different salt crystals can be classified.

In a case in which a rock containing several mineral components has been crushed and ground to have a suitable particle size and thereafter introduced in a suitably heated reactor in which suitable flow conditions prevail, the material will be swiftly heated. Thereby chances are that, owing to the thermal shock the material is subjected to, small cracks develop in certain minerals or on the boundaries between different minerals, since different minerals are differently affected according to the minerals' different specific properties. If the crystal structure of the minerals changes, the crystal volume is also most often affected, which in turn increases the crack formation and the disintegration of particles. If the flow conditions within the reactor are proper, enabling heated gases to keep the particles floating and in motion, attrition effects will contribute to those materials being comminuted which are lower in hardness or in which cracking has taken place. After the process has attained equilibrium and the material balance has been established, the disintegrated material fraction may be drawn out from the reactor by means of an appropriate gas flow and separated e.g. in a classifier. The coarser fraction may be extracted from the bed. If needed, the material fractions may be divided according to particle size or desired mineral content in that the material is partly taken out as finished product and partly returned to the reactor.

The thermal concentrating process may be applied for mineral mixtures in which e.g. spodumene is concentrated from a mixture of spodumene, quartz and feldspar; wollastonite is concentrated from a mixture of wollastonite and calcite; dolomite is concentrated from a mixture of dolomite and quartz or from a separation of dolomite into fractions rich in Mg and Ca.

For the purposes of the thermal concentrating method, an expedient reactor may be of the vortex bed type (see e.g. the Finnish Patent No. 54160, and Daizo Kunü and Octave Levenspiel, 'Fluidization Engineering', 1969, p. 29–31), in order to attain good heat transfer, suitable gas flow conditions and suitable circumstances of particle motion. The material composition should preferably be ground down to particle diameter −2 mm. No lower limit for particle diameter is necessary, but it may be to advantage in some cases to have the finest-ground particles separated before the material is fed into the reactor. The reactor may be either indirectly or directly heated. In order to obtain suitable agitation of the material in the reactor, suitable gas flows may be directed against the material. The gas flow in the reactor should also be controlled so as to enable the desired quantity of small particles to be carried out from the reactor and separated from the gas flow utilizing for instance a filter, a cyclone, a sieve, a pneumatic classifier or a Venturi scrubber.

To be sure, it is known in the art to treat different kinds of material in a vortex bed reactor and thereafter to conduct the gas together with its contents of solid particles to a cyclone separator. However, the object of this has above all been either to dry or to react the solid material and thereafter to separate the finer particles entrained with the gases, in a cyclone separator. Such apparatus has not been utilized towards classifying a crystal mixture or concentrating rocks or mixed crystals in particle form by means of heating the particles to a temperature high enough to achieve differences in the weight and/or volume of different particles sufficient for separation. It should be particularly noted that the present invention enables such particles to be separated which otherwise would be absolutely impossible or difficult to separate by conventional methods of separation. It is thus understood that it is not enough to raise the temperature of the particles: the temperature must be elevated enough to achieve a difference in weight and/or volume between particles sufficient for separation, though without incurring sintering. The heat content of the particles may thereafter be utilized by directly feeding them into a suitable pyrotechnical process step.

DESCRIPTION OF THE PREFERRED EMBODIMENT

Figure 1:
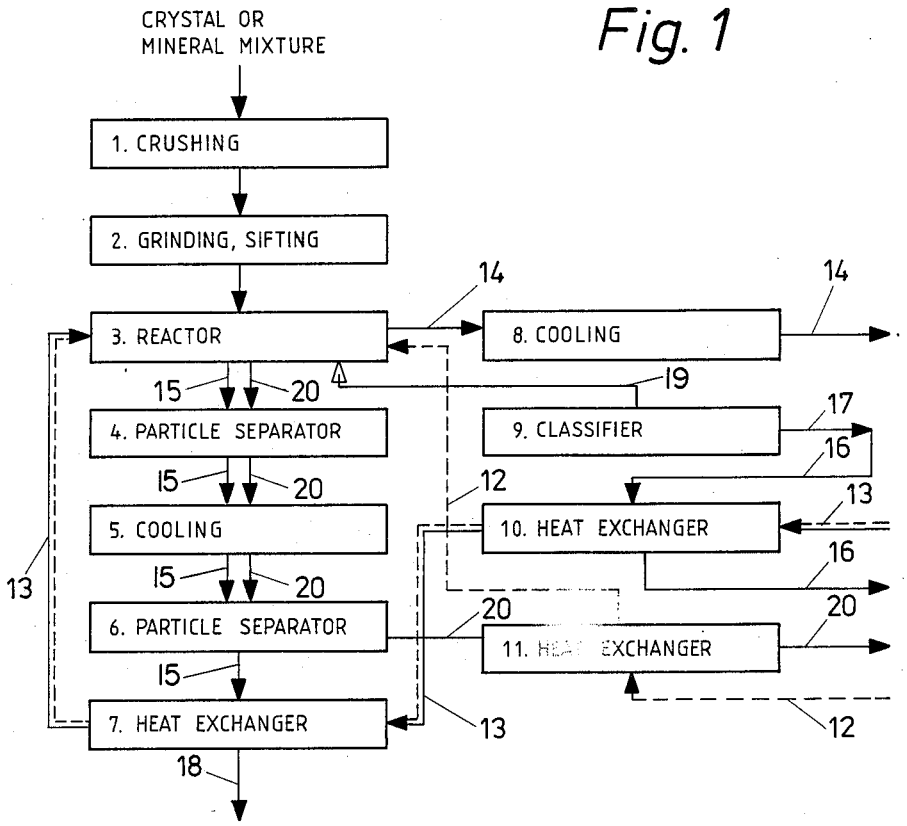
FIG. 1 presents a schematic flow chart of the thermal concentration according to the present invention.

The crystal or mineral mixture undergoes crushing 1 and grinding 2 to suitable particle size (minimum 50 % less than 2 mm). Thereafter, the material is introduced in a reactor 3, to which fuel 12 and gas 13 are also conducted and wherefrom a material flow 14, containing coarse particles, may by means of a heat exchanger 8 give off thermal energy. The material flow 15 containing fine particles in the exhaust gas 20 is fed into a particle separation system 4, 5, 6, 9, which may, in accordance with process conditions, consist of a filter, sieve, cyclone, pneumatic classifier, Venturi scrubber, or any combination of these.

The material flow 15 containing fine particles may thus be divided into a number of fractions 16 and 18, with varying sizes and crystal contents. Those fractions which may constitute products of various grades, or even waste, may be returned 19 to the reactor 3 if necessary. In order to obtain better thermal economy in the process, different types of heat exchangers 7, 10, 11 may be installed. Material fractions that have been taken out may also in heated condition be introduced in subsequent process systems which require heated material flows. The exhaust gas 20 passing through the particle separator 4, the cooling step 5, the particle separator 6 and the heat exchanger 11 is taken out from the last-mentioned after having delivered heat to the fuel 12.

EXAMPLE

Figure 2:
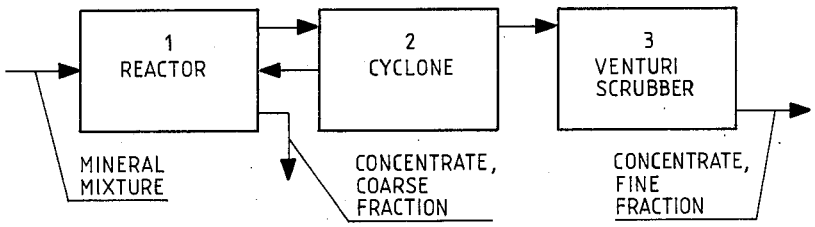
FIG. 2 shows another flow chart particularly intended for concentrating spodumene from a mineral mixture containing spodumene, quartz and feldspar.

A mineral mixture, having the composition of 61 % by weight spodumene and 39 % by weight quartz and feldspar, and having an average particle diameter of 0.19 mm, was introduced in a vortex bed reactor connected as shown in FIG. 2, where the reactor is indicated by the reference numeral 1, the cyclone by 2 and the Venturi scrubber by 3. The temperature in the reactor 1 was 1000° C., produced by burning light fuel oil. The diameter of the reactor was 300 mm and its height, 3400 mm.

The material supply rate to the reactor was 29.9 kg per hour, and 11.5 kg per hour of coarse fraction concentrate and 18.4 kg per hour of fine fraction concentrate were obtained. The content of spodumene in the fine fraction concentrate from the scrubber 3 was 83 % and in the coarse fraction concentrate from the reactor 1, 27.0 %. Thus, in the fine fraction concentrate the spodumene content increased 22 per cent units, while the quartz and feldspar content in the coarse fraction concentrate increased 34 per cent units.

At temperatures around 1000° C., the spodumene crystals undergo structural transformation from alpha to beta modification, and in that connection a crystal expansion of about 23 % by volume takes place, the density decreasing from 3.15 to 2.41 g/cm$^3$. The volume expansion of feldspar and quartz on heating to 1000° C. is about 2 to 3 %. The Mohs hardness of the minerals is between 6 and 7.

We claim:

1. A process for classifying a raw material in particle form comprising a mixture of at least two types of crystalline particles which have closely similar specific gravities at room temperature and one of which expands in volume to a substantially greater extent than the other when subjected to heat, said process comprising:

(a) subjecting said mixture to heat sufficient to effect said expansion in volume and relative decrease in specific gravity of said crystalline particles of said one type, and (b) subjecting said heated mixture to gravitational force effecting separation of said more greatly expended particles of said one type from the remainder of said mixture.

2. The process of claim 1 wherein said separating step is carried out by suspending said heated particles in a gas flow, and subjecting the resulting suspension to centrifugal force.

3. The process of claim 1, wherein said particles of raw material are heated and fluidized in a vortex bed by the aid of hot combustion gases, a coarse fraction being withdrawn from the vortex bed, while at least one finer fraction is separated from the gases that have passed through the vortex bed.

4. The process of claim 1, in which part of the coarser fraction of fractions is returned and heated once more to obtain further separation.

5. The process of claim 1, in which said particles of raw material have a diameter substantially less than 2 mm.

6. The process of claim 1, in which said raw material is a mineral mixture of spodumene, quartz and feldspar and said particles of raw material are heated to a temperature between 900° and 1000° C.

* * * * *